US009868039B2

(12) United States Patent
Brandt

(10) Patent No.: US 9,868,039 B2
(45) Date of Patent: Jan. 16, 2018

(54) BAT BREAK-IN TESTING METHOD AND ASSOCIATED APPARATUS

(71) Applicant: Richard A. Brandt, New York, NY (US)

(72) Inventor: Richard A. Brandt, New York, NY (US)

( * ) Notice: Subject to any disclaimer, the term of this patent is extended or adjusted under 35 U.S.C. 154(b) by 0 days.

(21) Appl. No.: 15/072,785

(22) Filed: Mar. 17, 2016

(65) Prior Publication Data

US 2016/0296813 A1 Oct. 13, 2016

Related U.S. Application Data

(60) Provisional application No. 62/144,481, filed on Apr. 8, 2015.

(51) Int. Cl.

| | |
|---|---|
| ***A63B 60/42*** | (2015.01) |
| ***G01L 1/22*** | (2006.01) |
| *A63B 102/24* | (2015.01) |
| *A63B 102/20* | (2015.01) |
| *A63B 102/18* | (2015.01) |

(52) U.S. Cl.

CPC ..... *A63B 60/42* (2015.10); *A63B 2102/18* (2015.10); *A63B 2102/182* (2015.10); *A63B 2102/20* (2015.10); *A63B 2102/24* (2015.10)

(58) Field of Classification Search

CPC ..... A63B 60/42; A63B 60/02

USPC ..... 73/818, 12.01

See application file for complete search history.

(56) References Cited

U.S. PATENT DOCUMENTS

| | | | | |
|---|---|---|---|---|
| 7,017,427 B1 * | 3/2006 | Vacek | ..... | G01N 3/08 73/862.631 |
| 2010/0326201 A1 * | 12/2010 | Brandt | ..... | G01N 3/08 73/818 |

* cited by examiner

*Primary Examiner* — Lisa Caputo
*Assistant Examiner* — Jamel Williams
(74) *Attorney, Agent, or Firm* — R. Neil Sudol; Henry D. Coleman

(57) ABSTRACT

A method for use in testing sports equipment such as a baseball bat for conformity to a performance standard or specification utilizes a compression contact member having a geometrical form identical in whole or in part to a baseball. In the method one supports one side of the bat in a cradle and presses the contact member into the batting member at a point of maximum performance on the bat. One continues alternating between compressions of successively increasing depth and elasticity test compressions, pausing to measure performance when the elasticity increases by a given percentage. The bat passes if it exhibits damage prior to exceeding a maximum permissible performance level or if its performance level is still less than that maximum once a maximum compression depth is attained.

16 Claims, 5 Drawing Sheets

Bat compression between hemisphere and cradle

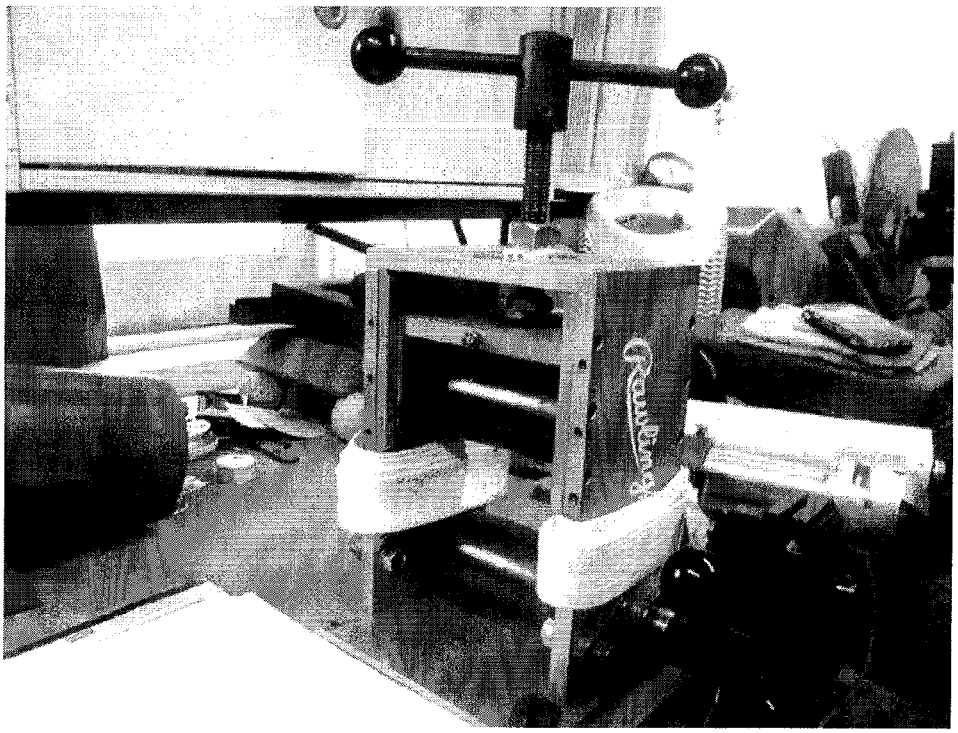
Figure 1. Bat rolling device (prior art)
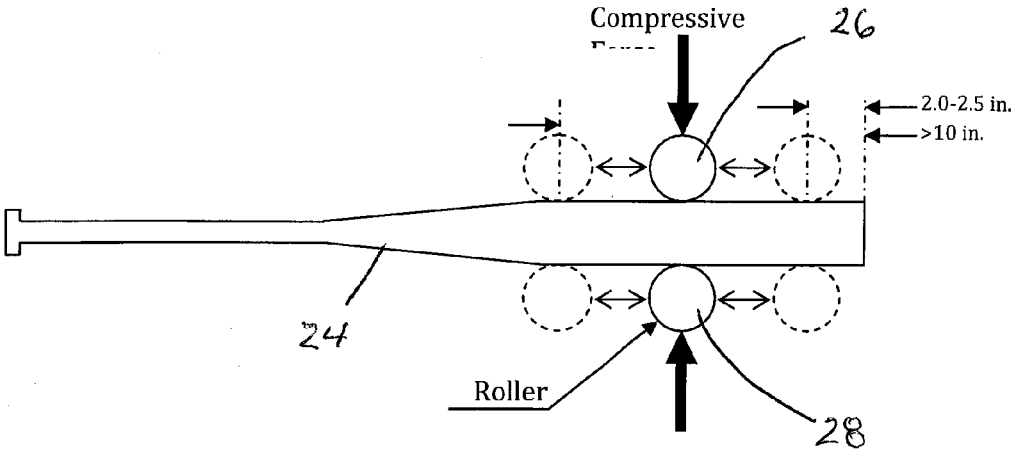
Figure 2. Bat rolling procedure (prior art)

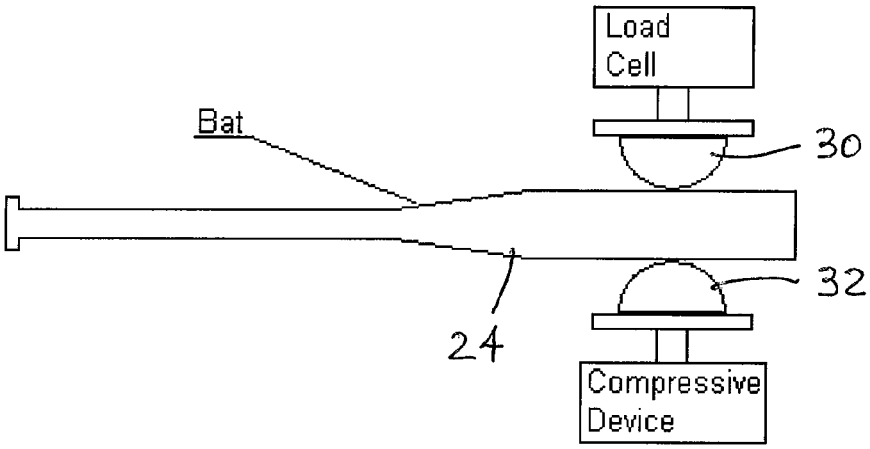
Figure 3. Bat compression between cylinders (prior art)
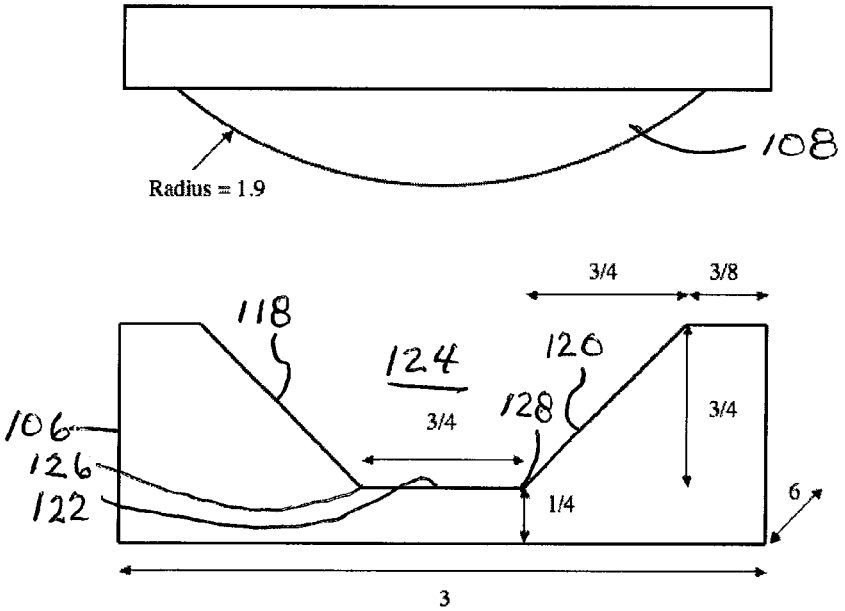
Figure 4. Bat cradle and compression element (dimensions in inches)

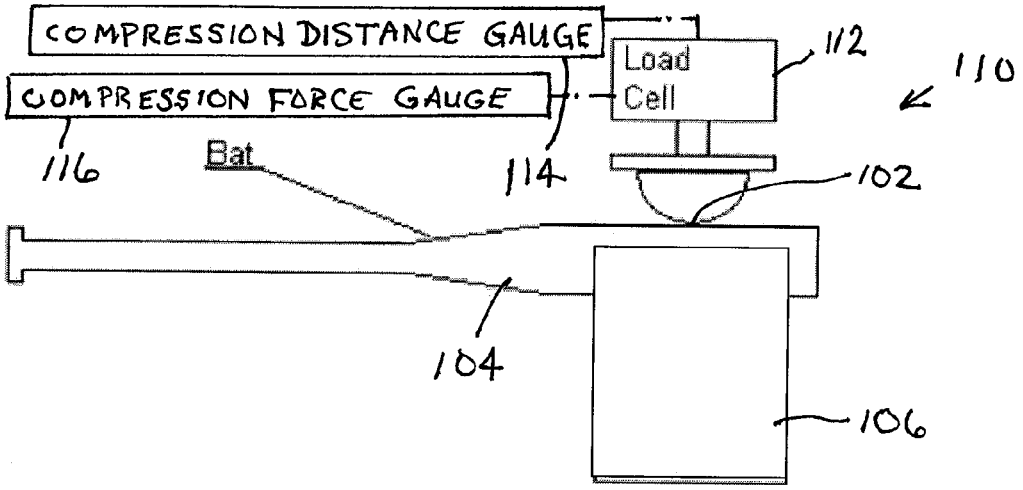
Figure 5. Bat compression between hemisphere and cradle
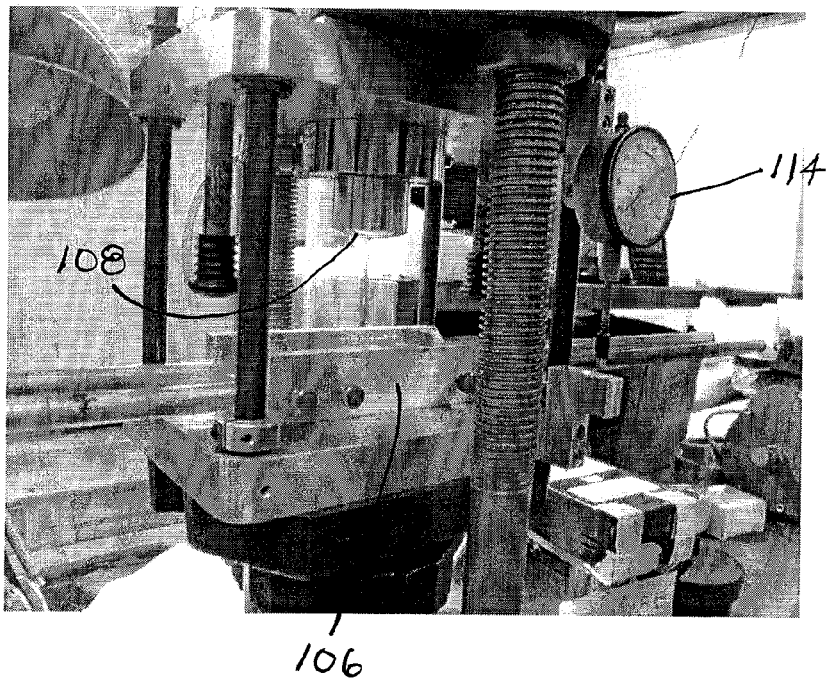
Figure 6. Photograph of bat cradle and compression element.

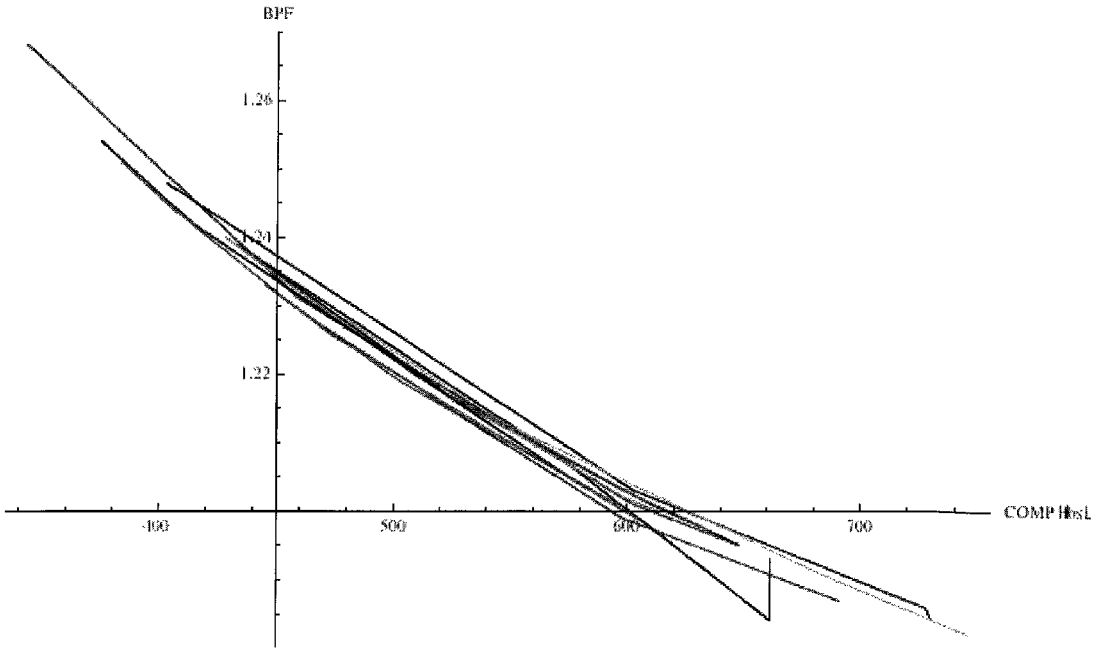
Figure 7. Plot of BPF verses compression for various bats

| SB ABI BPF TEST REPORT | | | August 26, 2015 |
|---|---|---|---|
| Richard Brandt | Testing Laboratory | FILE: | BAT |
| Sport Science Inc. | SportScience | BCS15-b1 | Batco |
| 2 Fifth Avenue | 27 West 20th Street | Client: | 017031 |
| Suite PHG | Suite 704 | Bat Company | Hitter 2.1 |
| New York, NY 10011 | New York, NY 10011 | Contact: | |
| office 212-929-1438 | lab 212-255-4147 | Bat Person | |

| sportslab@gmail.com | | | | NOTATION | |
|---|---|---|---|---|---|
| BAT PROPERTIES | | | | 0.05" barrel compr (lbs) | C |
| Weight | 23.93 | Mass | 678.4 | % change in C | D |
| Length | 34 | SS | cop | average BPF (ABPF) | B |
| Barrel | 2.25 | | | pass, fail | P, F |
| COM | 14.34 | | | pre-compress bat barrel | PC |
| COP | 21.14 | | | pre-compression distance (in) | dist |
| MOI | 7254.2 | | | visible damage observed | dam |

C1 is measured in step 1 below. C2,C3,... are measured after PCs.
Dij = 100(Ci-Cj)/Ci, where Cj is the most recently measured C, and Ci is the C measured immediately before the most recently measured B.
If B $\geq$ 1.245, use 5% C change, if B < 1.245, use 10% C change in step 4.

PROTOCOL NOTE: BPF = ABPF - 0.05

1. Measure C1 and B1. F if B1 $\geq$ 1.255.
2. If not F, apply PC. dist = 0.07"+(PC#-1)*0.02".
3. P if dam. Measure C and evaluate D if no dam.
4. If D < 5/10%, apply next PC and repeat 3.
   If D $\geq$ 5/10%, measure B. F if B $\geq$ 1.255.
5. Repeat 2 - 4 until P or F or dist = 0.15".
6. If dist = 0.15" and not P or F, meas B. P if B < 1.255, F if B $\geq$ 1.255.

| PRECOMPS | | DAM | COMPS (lbs) | | % CHANGE | | ABPF | | TEST |
|---|---|---|---|---|---|---|---|---|---|
| PC # | dist | (Y/N) | desig | value | desig | value | desig | value | (P/F) |
| 0 | 0 | N | C1 | 507 | | | B1 | 1.216 | |
| 1 | 0.07 | N | C2 | 502 | D12 | 0.99 | | | |
| 2 | 0.09 | N | C3 | 485 | D13 | 4.34 | | | |
| 3 | 0.11 | N | C4 | 451 | D14 | 11.05 | B2 | 1.225 | |
| 4 | 0.13 | N | C5 | 419 | D45 | 7.10 | | | |
| 5 | 0.15 | Y | | | | | | | P |

Figure 8. Typical bat test report

BAT BREAK-IN TESTING METHOD AND ASSOCIATED APPARATUS

BACKGROUND OF THE INVENTION

This invention relates to a testing method for use in determining whether a batting member utilizable in a competitive sporting game complies with predetermined performance standards. The invention also relates to an associate apparatus utilizable in carrying out the method.

Performance standards on baseball and softball bats have been in effect since first proposed over twenty years ago. The standards were introduced to limit the hit ball speeds produced by these bats in an effort to insure the safety of the players and the integrity of the game. The standards were originally intended to insure that metal bats did not perform significantly better than the wood bats that were historically used. When high-performing composite (mainly carbon-fiber) bats were subsequently introduced, they were subject to the same standards, but it was found that these standards had to be generalized in order to account for the special characteristics of the new bats.

It was soon realized, however, that the performance of composite bats improved with usage. Each ball impact experienced by these bats tended to delaminate or otherwise damage the carbon fibers, causing the bat to become more elastic and more powerful. These bats could therefore be found compliant with the existing standard when they were tested before being used to hit balls, but could become non-compliant (too powerful) if tested after sufficient usage.

In addition to the increase in performance of composite bats arising from usage, the performance of these bats can be artificially increased. This can be done by pushing and pulling the bat 24 between rollers 26 and 28 (FIGS. 1 and 2) compressed onto it, or by simply impacting the bat with balls or other objects. Another way to increase the performance of a composite bat is to shave out material from the inside of the bat's barrel.

In order to take these performance increases into account, some baseball and softball organizations proceeded to adopt an "automated break in" (ABI) procedure into the testing procedures. In these protocols, performance measurements on a tested bat are alternated with "breaking-in" procedures using a rolling device 20 (FIG. 1). One such protocol is the following. After an initial performance measurement, a bat's elasticity is measured by compressing the bat 24 a specified distance between a pair of cylindrical sections 30 and 32 (FIG. 3). The bat is then rolled by cylinders 26 and 28 compressed into it a specified distance. A second elasticity measurement is then made at the same specified distance as before, followed by a second rolling at a greater distance into the bat. This procedure continues until the bat's elasticity has decreased by a specified percent (typically 10%). The bat's performance is then measured again, and this procedure is continued until either the bat's performance exceeds a specified limit or the bat exhibits visible damage. If the damage occurs first, the bat is considered compliant, but if the performance limit is exceeded first, the bat is not considered compliant. The hope is that similar damage on a compliant bat caused by impacts during a ball game could then be observed, and the bat could be then be removed from play before it became non-compliant.

The above barrel rolling machines typically use two nylon cylinders of diameter between 1.5" and 3". These are set within a fixture that can press them into a bat barrel in increments of 0.0125". At least one of these rollers can be rotated within the fixture so that the bat barrel can be rolled between them. A typical barrel-rolling device is shown in FIG. 1 and illustrated in FIG. 2. The corresponding elasticity measurement device is illustrated in FIG. 3.

There are a number of serious problems with this rolling ABI protocol. It is complicated and time-consuming to use. It is not precise, accurate, controllable, or repeatable. It adds an element of influence by the tester to the otherwise accurate performance measurements. It requires the tester to determine the degree of compression and to determine visually if and when damage occurs anywhere on the bat barrel. The result of a test can depend on details of the rolling procedure not precisely controllable, such as the exact compression distance, the rolling speed, and the bat's alignment during the rolling. The rolling cannot be accurately performed on bats with tapered barrels. Another serious problem is that a bat could show damage when rolled to a sufficient distance, but not when impacted by balls. Such a bat could become non-compliant (too powerful) because of impacts with balls, but would not be removed from play because it would not display visible damage arising from these impacts.

The use of such a rolling device to execute automated break-in is therefore problematic. A typical protocol calls for roller compression distance increases of 0.0125", and bat rotations of 45°, etc., but the rolling devices are not capable of providing such precise values. Also, the rolling itself is a broad and harsh procedure that lacks adequate controls. The procedure is inefficient because it softens the bat everywhere and not in the way that ball impacts soften it. Also, the elasticity measurements are executed with two opposing cylindrical sections instead of with a spherical-like section at a single area, which is the way a struck ball experiences the elasticity of a bat. The following description will teach how all of these problems can be overcome by using different automated break-in equipment. To be specific, references herein are to baseball/softball bats, but it is understood that the same type of equipment and methods can be used to break in other sports equipment.

OBJECTS OF THE INVENTION

It is an object of the present invention to provide a method and/or an associated apparatus for use in measuring susceptibility elasticity of baseball and softball bats, and similar sports equipment, to performance enhancement owing to use.

It is another, related, object of the present invention to provide a method and/or an associated apparatus that may be used in testing baseball and softball bats to enforce and maintain safety standards.

Another related object of the present invention is to provide such a method as being more congruent with sports as actually played.

Yet another object of the present invention is to provide such a method that has enhanced controllability and reliability relative to conventional methodologies.

These and other objects of the present invention will be apparent from the drawings and descriptions herein. It is to be noted that any single embodiment of the invention may not achieve all of the objects of the invention, but that every object is attained by at least one embodiment.

SUMMARY OF THE INVENTION

A method for use in testing sports equipment for conformity to performance standards utilizes, in accordance with the present invention, a compression contact member having a geometrical form approximating that of a target sports object struck by a prescribed form of striking member in playing a given sport. For instance, if a baseball bat is being tested, the contact member has at least in part the size and spherical shape of a baseball. The contact member may be a spherical section instead of a complete sphere. The baseball bat is a sports batting member of prescribed form. The method comprises supporting one side of the batting member and during that supporting, pressing the contact member into the batting member at a predetermined point on the batting member.

The pressing of the contact member may include pressing the contact member a first pre-specified distance into the batting member. In that case, the method further comprises, during the pressing of the contact member into the batting member, determining an initial magnitude of compression force applied to the batting member to press the contact member into the batting member the pre-specified distance. Subsequently, while one supports the one side of the batting member, the contact member is pressed a second pre-specified distance into the batting member at the predetermined point, the second pre-specified distance being greater than the first pre-specified distance by a fixed amount. Then, while one supports the one side of the batting member, the contact member is again pressed the first pre-specified distance into the batting member at the predetermined point, and during that pressing again, one determines another magnitude of compression force applied to the batting member to press the contact member into the batting member the first pre-specified distance. The other magnitude is compared with the initial magnitude and, upon a determining that the other magnitude is less than the initial magnitude by a predetermined percentage, a test of performance is conducted on the batting member at the predetermined point.

Pursuant to further features of the present invention, the fixed amount is a multiple of a predetermined incremental distance, and the pressing of the contact member the second pre-specified distance into the batting member at the predetermined point is one of a plurality of pressings of the contact member into the batting member at the predetermined point, each successive one of the pressings being to a respective pre-specified distance greater than the pre-specified distance of an immediately prior pressing by the incremental distance. The method then further comprises determining, after each of the pressings, a respective magnitude of compression force applied to the batting member to press the contact member into the batting member the first pre-specified distance, comparing the respective magnitude with the initial magnitude, and upon determining that the respective magnitude is less than the initial magnitude by a predetermined percentage, conducting a test of performance on the batting member at the predetermined point.

The conducting of the test of performance typically includes inspecting the batting member for damage and may further include generating a numerical measurement and comparing the numerical measurement with a predetermined maximum index of permissible performance.

The batting member can be any sporting bat, for instance, a baseball bat, a softball bat, a hockey stick, or a cricket bat.

The method may further comprise performing a test on the batting member to determine the point of maximum performance and selecting the predetermined point as the point of maximum performance. Determining of the point of maximum performance preferentially includes conducting a test of performance on the batting member at a plurality of points spaced from each other along a length of the batting member.

The supporting of the batting member may specifically have the form of supporting the batting member on a cradle.

An associated apparatus for determining safety and/or performance of sports equipment comprises a frame, a cradle member supported on the frame and having a channel for holding a sports batting member to be tested, where the sports batting member is of a predetermined geometry used to strike a sports object of predetermined weight and geometry. The apparatus further comprises a contact member having a geometrical form that approximates, or is identical at least in part to, the sports object. The contact member is movably mounted to the frame member and a drive is operatively connected to the frame and the contact member for pressing the latter a determinable or controllable distance into the sports batting member on the cradle member.

The cradle member may have, for instance, three rectangular surfaces, two of the surfaces being joined to longitudinal edges of a third one of the surfaces to form a trough with diverging sidewalls.

The contact member typically takes the form of a sphere or a portion thereof.

The apparatus may further comprise a force sensor or gauge operatively connected to the drive for providing a numerical measure of force applied to the batting member via the contact member.

The apparatus may additionally comprise a distance gauge for providing a numerical measure of compression depth applied to the batting member via the contact member.

The present invention provides a method and an associated apparatus to simulate the breaking-in of sports bats and similar equipment by locally compressing the equipment.

The present method and apparatus enables one to determine the degree of performance-improvement of bats from impacts with sports balls. When performance rises above a pre-established threshold, adopted in the respective sport for purposes of maintaining fairness of play, a bat may be designated as non-compliant and banned from use in sanctioned sports competition.

In contrast to conventional sports equipment testing and breaking-in methods, the present method is advanced as being more congruent with sports as actually played, inasmuch as applied compressions for testing purposes are similar to the compressions arising from impacts with sports balls in the respective games.

The present method is considered more accurate than conventional testing methods for the further reason that the applied compressions are preferentially, although not necessarily, centered at the point of maximum performance of the bat under test.

Pursuant to the present method, the applied compressions compress the bat to specified distances to controllably and reliably simulate performance changes owing to use in actual games. The elasticity of a bat under test is measured after each applied compression to trigger performance testing for determining whether the elasticity has changed to such a degree that the bat under test has become too powerful or unsafe or otherwise out of conformity with official standards. The elasticity of a bat is defined and measured as the force required to compress the bat a specified distance. The apparatus of the present invention preferably includes a force or pressure gauge for measuring the force.

The controllability and reliability of the present testing method arises in part from measuring the elasticity of the tested batting member by compressing the bat with the same element used to execute the break-in compressions. After an initial performance measurement, the alternating elasticity-measurements and compression-executions continue until the measured elasticity has decreased from it's starting value by a specified amount, at which point a new performance measurement is made.

The compression-(elasticity-measurement)-(performance-measurement) cycles continue until one of the following occur: (a) damage to the bat barrel is observed in the compression area; (b) the performance measurement exceeds a specified value; (c) the applied compression distance reaches a specified value.

It is to be noted that the contact member of the testing apparatus may be a curved solid section that is geometrically identical, at least approximately, to a portion of a sports ball or other batted object. Alternatively, the break-in compression element may be a solid spherical section, with a radius equal to that of a game ball of the subject sport.

BRIEF DESCRIPTION OF THE DRAWINGS

FIG. 1 is a perspective view of a prior art bat-rolling device for use in testing baseball and softball bats for conformity to a performance standard.

FIG. 2 is a schematic side elevational view of a bat between two rollers of a rolling device as that shown in FIG. 1.

FIG. 3 is a schematic side elevational view of a bat between two cylindrical sections of a bat compression device of the prior art.

FIG. 4 is a schematic exploded front elevational view of a cradle and compression contact member for use in a bat testing method in accordance with the present invention.

FIG. 5 is a schematic side elevational view of the cradle and compression contact member of FIG. 4, showing a bat in an operative testing position.

FIG. 6 is a front and side perspective view of a sports equipment testing apparatus in accordance with the present invention, including the cradle and compression contact member of FIGS. 4 and 5.

FIG. 7 is a graph of a bat performance factor or index as a function of force required to compress a bat to a predetermined degree.

FIG. 8 is a front elevational view of a sample test report template with entries derived in part by performing the testing method of the present invention.

DETAILED DESCRIPTION

While the present description is directed to baseball and softball bats, those skilled in the art will recognize that the apparatus and methodology can be readily used with minor modifications, if any, to test the conformance of other sports equipment, particularly including batting members such as hockey stick and cricket bats, with performance standards.

The alternative ABI procedure taught herein overcomes all of the difficulties discussed above with respect to conventional techniques and testing equipment. In a preferred embodiment, the first step is to determine the point of maximum performance 102 on a bat 104 under test (FIG. 5) where performance is measured by a relevant protocol such as BPF. All subsequent performance measurements and compressions for simulating the breaking in of a bat are made at this maximum performance point 102. In a further preferred embodiment, the elasticity the bat 104 at each step is determined with the bat held in a cradle 106 so that the bat is compressed on only one side, as it is when the bat is impacted by a ball. (In the prior-art ABI procedure, the bat being tested is compressed on two opposite sides, by cylindrical elements.)

In a further preferred embodiment, the compressing solid or compression contact member 108 is a spherical section, with a radius equal to that of a softball or a baseball when the bat 104 is respectively a softball bat or a baseball bat. The compression is therefore similar to a compression arising from an impact with a ball of the selected sport. Preferably, this same compression mechanism 110, including cradle 106, compression contact member 108 and a mechanical drive or load cell 112, is used to execute the break-in of the bat 104. These break-in compressions, to specified increasing distances, are therefore also similar to compressions arising from an impact with a ball. This procedure is thus very efficient, because the same device 110 is used for both elasticity measurements and bat break-ins, and precise, because, unlike for rolling devices, the compression distances can be set very accurately. And since the bat 104 is compressed in the present ABI procedure the same way that it is compressed during hits in ball games, a bat of the same manufacture and specifications as a tested bat 104 that shows damage in the ABI procedure before the bat 104 becomes too powerful would also show damage when impacted by balls before exceeding a predetermined performance threshold.

In order to determine appropriate compression distances and quantitatively determine the degree to which compressions of a bat increase the performance of the bat, the inventor tested 11 softball bats (lengths 34", diameters 2.25", weights 27-30 oz). The performance metric was the Bat Performance Factor (BPF, as defined in U.S. Pat. No. 5,672,809, entitled "Method and Apparatus for Determining the Performance of Sports Bats and Similar Equipment"). The BPF standard is currently in use by the United States Specialty Sports Association (USSSA), Little League Baseball, and other sports associations. For each bat, the inventor first measured the BPF and the force required to compress the point of maximum BPF a distance of 0.05", and then he compressed the point of maximum BPF to a distance of 0.10", and again measured the BPF and 0.05" compression force. The inventor then repeated this sequence at the compression distances of 0.15" and 0.20".

The BPF measurements and the compression measurements at 0.05" were performed in order to determine the degree to which the pre-compressions increased the BPF and decreased the stiffness of the bats. The compressions were performed with each bat 104 held in cradle 106 so that the point of compression 102 is indented the full 0.05" distance. (For comparison, note that if a bat 104 were compressed between two opposite compression rollers, it would require a 0.10" total compression distance to indent each side 0.05".) The 0.05" compression distance was selected because that is a typical distance for game impacts. The compression contact member 108 was a spherical solid or solid section, with a radius of 1.91", the radius of a 12" circumference softball. A specific instance of this compression system 110 is shown in FIG. 6.

The measurement results were as follows, starting with the effects of the pre-compressions on BPF. With no pre-compression, 9 of the tested bats had compliant BPFs in the range 1.182-1.200, but 2 of the bats were slightly non-compliant, with BPFs of 1.202 and 1.203. After the 0.10" compression, 10 of the BPFs increased slightly, and 1 increased dramatically. The result was that 5 bats became slightly non-compliant, with BPFs in the range 1.201-1.204, and 5 remained compliant, with BPFs in the range 1.186-1.199. The remaining bat acquired a BPF of 1.226. After the 0.20" compression, all of the bats became non-compliant, with BPFs over 1.200.

The conclusion is that compressions in the 0.15"-0.20" range are sufficient the increase the BPFs of all tested bats over the 1.20 limit. The reason that bat compressions improve bat performance is that these compressions soften the bat. This softening is demonstrated by measuring the force required to compress each bat 0.05" after each pre-compression. With no pre-compression, the forces were typically in the range 500-600 lbs. After the 0.20" compression, all of the bats softened considerably, requiring 0.05" compression forces in the range 300-400 lbs. This corresponds to the fact that all the bats acquired BPFs above 1.200 after the 0.20" compression.

As an exhibition of some of the acquired data, the FIG. 7 graph of BPF verses the forces required to compress each bat 0.07" (COMP). This graph displays how BPF increases as the compression force COMP decreases. The fact that the individual trend lines are approximately parallel and close together demonstrates the strong correlation between BPF and COMP or between bat performance and bat breaking in during use.

These results quantify the extent to which compressing a bat 104 at a single point 102 softens the bat and improves its performance at that point. There are four main ways in which such softening empirically occurs on a bat: (1) from the impacts of softballs/baseballs on the bat during games and practice, (2) from impacts arising from hitting the bat against an object, (3) from running the bat through a rolling machine, (4) from shaving layers off of the inside of the bat barrel. In order to prevent these or other procedures from softening a bat to the extent that its performance increases beyond the compliant level (1.20 BPF), softball organizations should require bat manufacturers to design sanctioned bats such that they show visible damage when subjected to large enough compressions. When such damage, arising from ball-bat impacts, is observed in ball games, such bats could then be removed from play before they exceed the performance limit.

The accelerated break-in procedure that is taught herein subjects composite bats to realistic compressions in order to simulate the performance-increasing break-in effects arising from the use of the bats in ball games. These compressions soften composite bats and generally improve their performance. Compliant bats are required to show visible damage (cracks, flaking, delaminations, etc.) before they exceed the designated BPF limit (1.20 for softball, 1.15 for youth baseball). (The BPF for softball incorporates a 0.05 subtraction, so that the real average BPF limit is 1.25.) Bats that show visible damage after compression can be safely used in games because performance increases arising from ball impacts will show similar damage. Officials would be instructed to remove a bat from play if it shows such damage.

The above stated BPF bat performance metric, and the specific BPF limits, are those adopted by the USSSA. The break-in equipment and protocol taught here is more general and can be used in accordance with any bat performance metric, and any specified limits on the performance values. To be specific, reference is made in the following to the BPF metric and USSSA values, but it is understood that the protocol is completely general.

In a detailed preferred version of the inventive protocol, the compressing solid or compression contact member 108 is a spherical aluminum solid section, with a radius of 1.91", the radius of a 12" circumference softball. The compressions are performed with the bat 104 held in cradle 106 so that the point of compression 102 is indented the full compression distance. (For comparison, note that if the bat were compressed between two opposite surfaces or rollers, it would require twice the total compression distance to indent each side a given distance.) Preferred dimensions of the cradle are given in inches in FIG. 4. As further shown in that drawing figure, cradle member 106 has three rectangular surfaces 118, 120, 122 defining a channel or trough 124 with diverging sidewalls, two of the surfaces 118 and 120 being contiguous with longitudinal edges 126 and 128 of the third surface 122 to form the channel or trough.

Two types of compressions are relevant. Compressions to 0.05", and associated force measurements, are used to monitor the softness of a bat. (This is equivalent to a 0.1" compression distance if the bat were compressed between two opposing surfaces.) Compressions used to soften a bat start at 0.07" and increase by units of 0.02". The compression distances are thus 0.07", 0.09", 0.11", 0.13", and 0.15". Compression distances greater than 0.15" need not be used since this distance exceeds the impact distances encountered in ball games. (The 0.15" distance is equivalent to a 0.30 compression distance in a rolling machine.) If a bat shows no damage after the 0.15" compression, and still has BPF under the limit, the bat will be considered to be compliant.

A preferred procedure is to use the bat compression device described above to implement the ABI compliance testing procedure. As with rolling ABI, the procedure is to alternate between increasing bat compressions and BPF measurements, until either the bat shows visible damage or it's BPF exceeds 1.200. The complete preferred procedure is given in the following ten steps.

1. Measure the BPF of a bat 104 to be tested and find the point 102 of maximum performance. All subsequent measurements are to be made at this point 102. If the maximum BPF exceeds 1.200, the bat fails. If the maximum BPF does not exceed 1.200, continue as follows.
2. Measure the compression force applied to compress the bat 104 at point 102 to a distance of 0.05".
3. Further compress the bat 104 at point 102 to 0.07".
4. Re-measure the compression force at 0.05" compression distance.
5. Further compress the bat 104 at point 102 to 0.09".
6. Re-measure the compression force at 0.05".
7. Continue to compress further, in increments of 0.02", and re-measure the compression force at 0.05" until this force decreases from the original value (step 2) by at least 10%. (If the initial BPF maximum value is greater than 1.194, replace the 10% decrease with a 5% decrease.)
8. Re-measure the BPF.
9. Continue performing steps 7-8 until the bat displays visible damage or has a BPF greater than 1.200. If visible damage occurs first, the bat passes. If BPF>1.200 occurs first, the bat fails.
10. If, after compressing to 0.15", the bat does not display damage, measure the BPF again. If this final BPF value does not exceed 1.200 BPF, the bat passes.

This protocol is similar to the one described in the prior art that uses a rolling machine to soften bats instead of the localized compression described here. As explained above, some of the advantages of the present procedure are the following: (1) it is much simpler and quicker to use than conventional methods, (2) it is much more precise, accurate, controllable, and repeatable (compression distances are accurate to 0.001", whereas rolling machine distances are accurate to 0.01"), (3) it concentrates the softening at the point of maximum performance (softening by rolling is broad and not uniform), (4) it compresses a bat in a way that is similar to the way that a ball impact does, (5) it can be used on bats with variable barrel diameters such as most baseball bats.

The following details complete the specification of a preferred embodiment of the present accelerated break-in procedure. The monitoring compressions of 0.05" are made as follows. With a bat 104 in the cradle 106, a measured force between 5 lbs and 15 lbs is applied. A compression distance gauge 114 (FIG. 5) will then be set to zero, and an additional compression to a distance of 0.01" will be applied. A compression force gauge 116 (FIG. 5) will then be set back to zero, and an additional compression to a total distance of 0.05" will be applied. The force C required to compress the bat this distance will be recorded.

The testing procedure begins by determining the point of maximum BPF on the bat barrel. If this maximum BPF B1 exceeds 1.20/1.15 (for softball/baseball), the bat fails and the test is over. If B1≤1.20/1.15, measure the first 0.05" compression C1. Then apply compressions at the same point, starting with a compression distance of 0.07" and increasing the distance in increments of 0.02", and measure the 0.05" compression values Ci after each such compression (#i). Proceed in this way until the measured 0.05" compression force decreases from the original value C1 by 5% or 10%. (Use the 5% decrease if B1≥1.195/1.145, and use the 10% decrease if B1<1.195/1.145). When such a decrease occurs, or if the compression distance reaches 0.15" without such a decrease, measure the BPF again. If this BPF value B2 exceeds the limit, the bat fails and the test is over. If B2 does not exceed the limit, and the compression distance was less than 0.15", compress the bat to the next distance and repeat the above procedure. If B2 does not exceed the limit, and the compression distance was equal to 0.15", the bat passes and the test is over. Continue in this manner until the bat either passes or fails.

To keep track of the measurement results, the 0.05" compression force measurements are designated C1, C2, C3, . . . , and the ABPF measurements are designated B1, B2, B3, . . . . If Ck is the compression measured immediately before a required ABPF measurement Bi, and Cj is a subsequent compression measurement, then the percentage difference between these two compression measurements is $$Djk=100\%*(Ck-Cj)/Ck.$$

When this difference exceeds 5/10%, the next ABPF B(i+1) must be measured. The final possible measured compression is C6 (corresponding to the fifth pre-compression distance of 0.15"). If this final pre-compression is required, a final ABPF measurement must be made, even if Di6 is less than 5/10%.

The details of this protocol are summarized in a test report template shown in FIG. 8. The numbers are appropriate to softball. For youth baseball, the ABPF limit changes from 1.250 to 1.150 (BPF=ABPF−0.050). For high-speed (110 mph) softball bat tests, the BPF limit is the same, but the BPF is defined as ABPF−0.125, so the ABPF limit is 1.330.

In the preferred embodiment described above, explicit specifications are provided for the softness monitoring compression distance (0.5"), the softening compression break-in distances (0.7", 0.09", 0.11", 0.13", and 0.15"), the dimension (1.9" radius) of compression contact member 108, the dimensions (FIG. 4) of bat cradle 106, and the testing protocol (FIG. 8). All of these specifications can be changed without changing the essence of the inventive equipment and protocol. The main inventive ideas are to use an accurate compression device that simulates the compressions created by ball impacts, with a ball-like element used to apply the compression on a single side of the tested bat, and to use the same compression element to both provide the compressions and monitor their effects. Accordingly, it is to be understood that the drawings and descriptions herein are proffered by way of example to facilitate comprehension of the invention and should not be construed to limit the scope thereof.

What is claimed is:

1. A method for use in testing sports equipment for conformity to a performance standard, comprising:

providing a compression contact member having a geometrical form at least partially approximating a target sports object struck by a prescribed form of striking member in playing a given sport;

providing a sports batting member of said prescribed form;

supporting one side of said batting member; and during supporting of said batting member, pressing said contact member into said batting member at a predetermined point on said batting member in a series of temporally spaced pressings each a respective distance into said batting member greater than each preceding pressing in said series.

2. The method defined in claim 1 wherein the pressing of said contact member includes pressing said contact member a first pre-specified distance into said batting member, further comprising:

determining an initial magnitude of compression force applied to said batting member to press said contact member into said batting member said first pre-specified distance;

subsequently, while supporting said one side of said batting member, pressing said contact member a second pre-specified distance into said batting member at said predetermined point, said second pre-specified distance being greater than said first pre-specified distance by a fixed amount;

subsequently, while supporting said one side of said batting member pressing said contact member said first pre-specified distance another time into said batting member at said predetermined point;

determining another magnitude of compression force applied to said batting member to press said contact member said another time into said batting member said first pre-specified distance;

comparing said other magnitude with said initial magnitude; and upon determining that said other magnitude is less than said initial magnitude by a predetermined percentage, conducting a test of performance on said batting member at said predetermined point, wherein the pressing of said contact member said second pre-specified distance into said batting member at said predetermined point is a first one of said series of pressings of said contact member into said batting member at said predetermined point.

3. The method defined in claim 2 wherein said fixed amount is a multiple of a predetermined incremental distance, each successive one of said pressings being to a respective pre-specified distance greater than the pre-specified distance of an immediately prior pressing by said incremental distance, further comprising:

determining, after each of said pressings, a respective magnitude of compression force applied to said batting member to press said contact member into said batting member said first pre-specified distance;

comparing said respective magnitude with said initial magnitude; and upon determining that said respective magnitude is less than said initial magnitude by a predetermined percentage, conducting a test of performance on said batting member at said predetermined point.

4. The method defined in claim 3 wherein the conducting of said test of performance includes inspecting said batting member for damage after each compression.

5. The method defined in claim 4, further comprising terminating testing of said sports batting member upon detecting damage to said batting member.

6. The method defined in claim 4 wherein the conducting of said test of performance includes generating a numerical measurement and comparing said numerical measurement with a predetermined maximum index of permissible performance.

7. The method defined in claim 3 wherein the conducting of said test of performance includes generating a numerical measurement and comparing said numerical measurement with a predetermined maximum index of permissible performance.

8. The method defined in claim 3 wherein said batting member is taken from the group consisting of a baseball bat, a softball bat, a hockey stick, and a cricket bat.

9. The method defined in claim 2, further comprising selecting said predetermined point as a point of maximum performance of said batting member, further comprising performing a test on said batting member to determine said point of maximum performance.

10. The method defined in claim 9 wherein the determining of said point of maximum performance includes conducting a test of performance on said batting member at a plurality of points spaced from each other along a length of said batting member.

11. The method defined in claim 1 wherein the supporting of said batting member comprises supporting said batting member on a cradle.

12. The method defined in claim 1 wherein said geometrical form of said contact member exhibits at least one geometric parameter at least approximately identical to a titular or nominal parameter of said target sports object.

13. The method defined in claim 12 wherein said at least one geometric parameter is a radius.

14. The method defined in claim 1 wherein said batting member is taken from the group consisting of a baseball bat, a softball bat, a hockey stick, and a cricket bat.

15. A method for use in testing sports equipment for conformity to a performance standard, comprising:

providing a compression contact member having a geometrical form at least partially approximating a target sports object struck by a prescribed form of striking member in playing a given sport;

providing a sports batting member of said prescribed form;

supporting one side of said batting member; and during supporting of said batting member, pressing said contact member into said batting member at a predetermined point on said batting member, further comprising selecting said predetermined point as a point of maximum performance of said batting member, further comprising performing a test on said batting member to determine said point of maximum performance.

16. The method defined in claim 15 wherein the determining of said point of maximum performance includes conducting a test of performance on said batting member at a plurality of points spaced from each other along a length of said batting member.

* * * * *